US008113400B1

(12) United States Patent
Santolalla

(10) Patent No.: US 8,113,400 B1
(45) Date of Patent: Feb. 14, 2012

(54) DUAL COMPARTMENT ROLLED FOOD STORAGE SHEET GOODS DISPENSER

(76) Inventor: Peter Santolalla, Boca Raton, FL (US)

( * ) Notice: Subject to any disclaimer, the term of this patent is extended or adjusted under 35 U.S.C. 154(b) by 708 days.

(21) Appl. No.: 12/255,286

(22) Filed: Oct. 21, 2008

Related U.S. Application Data

(60) Provisional application No. 61/015,225, filed on Dec. 20, 2007.

(51) Int. Cl.
*B26F 3/02* (2006.01)

(52) U.S. Cl. ..... 225/34; 225/6; 225/38; 83/650; 242/594.4

(58) Field of Classification Search ..... 225/34, 225/10, 23, 51, 53, 56, 63, 76, 37–39, 42, 225/46; 83/648–650; 242/594, 594.1, 594.3–594.5; 206/461, 464, 465, 467, 468, 470
See application file for complete search history.

(56) References Cited

U.S. PATENT DOCUMENTS

| | | | | |
|---|---|---|---|---|
| 2,819,851 | A * | 1/1958 | Robertson | 225/38 |
| 3,311,278 | A | 3/1967 | Brandon | |
| 4,003,526 | A | 1/1977 | Fishburn | |
| 4,369,929 | A | 1/1983 | Cayer | |
| 4,646,956 | A | 3/1987 | Ruff et al. | |
| 4,762,259 | A | 8/1988 | Kosa | |
| 4,844,310 | A | 7/1989 | Geleziunas | |
| 5,305,937 | A * | 4/1994 | Barnett | 242/594.6 |
| 5,630,563 | A | 5/1997 | Meisner et al. | |
| 6,793,097 | B2 | 9/2004 | Kamenstein | |
| 6,915,935 | B2 * | 7/2005 | Portnoy | 225/38 |
| 2004/0194601 | A1 * | 10/2004 | Lin et al. | 83/650 |

* cited by examiner

*Primary Examiner* — Phong Nguyen
(74) *Attorney, Agent, or Firm* — Gold & Rizvi, P.A.; H. John Rizvi; Glenn E. Gold

(57) ABSTRACT

A dual food storage sheet goods dispenser (100) having a housing comprising a lower cartridge containing section (101) and an upper cartridge containing section (118). The lower cartridge containing section (101) includes a dispensing slot (112) located horizontally across a bottom (110) of the housing. A cutting edge (108) and respective carrier (106) are assembled to the exterior of the bottom (110) between the slot (112) and a front edge. Access to the lower section (101) is provided via an access door (124). An upper cartridge containing section (128) includes a dispensing clearance (126) located horizontally between an upper edge of a front wall (122) and an access door (124). A cutting edge (128) is assembled to a top of the front wall (122).

20 Claims, 12 Drawing Sheets

DUAL COMPARTMENT ROLLED FOOD STORAGE SHEET GOODS DISPENSER

CROSS-REFERENCE TO RELATED APPLICATION

This Non-Provisional Application claims the benefit of U.S. Provisional Patent Application Ser. No. 61/015,225, filed Dec. 20, 2007, which is incorporated herein within its entirety.

BACKGROUND OF THE INVENTION

1. Field of the Invention

The present invention relates to food storage wrap dispensers in general and, more particularly, to a single dispensing apparatus for both plastic wrap and aluminum foil.

2. Discussion of the Related Art

This invention relates to a dispenser for rolled sheet goods, such as plastic wrap, aluminum foil, wax paper, and the like, and more particularly relates to a wall mountable or countertop dispenser for a plurality of rolled sheet goods.

Food wrap materials are packaged in dispensing rolls and placed within paper or cardboard rectangular shaped box. The lid on each box opens providing the user with access to the dispensing roll. The wrap material is pulled forward over a cutting edge located atop a front wall.

A variety of rolled sheet goods, such as plastic wrap, aluminum foil, wax paper and the like are used in kitchens. These sheet goods are generally manufactured as a continuous sheet and packaged on rolls placed in elongated rectangular boxes. The boxes generally have a hinged lid, and the end of the sheet goods is extended between the flap of the lid and a front wall of the rectangular box. The goods are unrolled and torn off, against a serrated metal strip affixed at the top of the front wall.

The wrap is provided in individual boxes. The boxes are not conducive to being stored in a manner desirable for ease of access and use. The rectangular boxes containing the rolled sheet goods are normally stored in kitchen drawers or cabinets, dictating a need for storage space within in drawers or cabinets. More importantly, the rolled sheet goods are not readily accessible when needed.

Several teachings provide dispensing apparatus for food storage sheet goods. Meisner, et al. (U.S. Pat. No. 5,630,563) presents a dispensing body comprising a containment space for a full roll of sheet material. Meisner is limited by the design, only allowing for the storage and dispensing of a single roll of sheet material. It is desirable to provide a plurality of sheet material types when working in the kitchen. Meisner cannot achieve that desire.

Brandon (U.S. Pat. No. 3,311,278) teaches a dispensing apparatus for food storage sheet goods comprising an outer clamp (36) pivotally assembled to the top of the housing. Brandon, like Meisner, is limited by the design, only allowing for the storage and dispensing of a single roll of sheet material. It is desirable to provide a plurality of sheet material types when working in the kitchen. Brandon cannot achieve that desire.

Several teachings present a dispensing apparatus capable of dispensing a plurality of different sheet goods. Cayer (U.S. Pat. No. 4,369,929) teaches a plurality of sheet material rolls placed vertically in a dispenser, each being dispensed at a respective corner of the apparatus. The design is limited by several factors: (1) The design is not conducive to being horizontally oriented. The user must turn the unit in order to dispense two or more of the sheet goods; (2) The design can not be wall mounted, and (3) Structurally, the slot must run the entire length of the side walls weakening the overall housing.

Kosa (U.S. Pat. No. 4,762,259) teaches a multi-sheet roll dispensing apparatus, the dispenser using two parallel side walls for holding each of the sheet rolls. Kosa is limited by the design, dictating that all of the rolls must be of the same width. The rolls are exposed, which is not desirable for food storage materials. Additionally, the design dictates that the apparatus be mounted for use.

Geleziunas (U.S. Pat. No. 4,844,310) teaches a sheet roll dispensing apparatus defined as having an elongated chamber that opens at the front. Geleziunas is limited by the design, wherein the cutting edge (74) is disposed upon the hinged lid (6). This design dictates the user to pull the sheet goods outward in a downward motion, then outward for a cutting step. The outward force can potentially lift the hinged lid.

Ideally, it is desirable to provide a storage apparatus for containing and dispensing a plurality of food storage wraps. The storage apparatus should be aesthetically pleasing and of a form factor that is functionally equal or better than the originally provided box.

SUMMARY OF THE INVENTION

The present invention is directed to a storage and dispensing apparatus for food wraps, more specifically a dispensing compartment comprising a first compartment for receiving and dispensing a roll of plastic wrap and a second compartment for receiving and dispensing a roll of aluminum foil.

A dispenser for rolled sheet goods according to the invention herein generally comprises a housing receiving at least one and preferably a plurality of rolled sheet goods in a horizontal orientation, with the housing defining a horizontal slot for each roll of sheet goods through which the sheet goods is dispensed. The desired amount of the sheet goods is drawn from the roll through the slot in the housing, the roll rotating within the goods containing section. A pair of end caps can be inserted into each end of the roll, the end caps providing a resistance and prevents it from turning, thereby preventing additional amounts of sheet goods from being dispensed and permitting the sheet goods to be pulled into tensioned condition and torn off at the edge of the slot. The edge of the vertical slot may be sufficiently sharp, preferably comprising a serrated cutting edge to facilitate cutting of the sheet goods.

In one preferred embodiment, each compartment within the housing is approximately square, the housing having interior partitions defining two vertical compartments each receiving one roll of sheet goods whereby the rolls of sheet goods The upper compartment comprising a front wall that is angled projecting outward towards the top. A shearing edge is disposed along the top edge of the front wall. An access lid is disposed along the top of the upper compartment. The lower compartment comprising a bottom floor comprising a horizontal slot. A cutting edge carrier is attached to an underside of the bottom floor located parallel to and forward of the slot.

The dispensers efficiently store and make readily available a plurality of rolls of sheet goods in an attractive countertop or wall mount unit.

Accordingly, it is a principal object of the invention herein to provide a dispenser for rolled sheet goods.

It is a further object of the invention herein to provide a dispenser for a plurality of rolls of sheet goods in an attractive unit adapted for countertop or wall mounted use.

Yet another aspect of the invention herein provides a dispenser for rolled sheet goods that is fabricated of few parts with simple construction, and is easy to operate and load.

Yet another aspect provides a dispenser that incorporates a simple, easy, repeatable, and safe means for cutting the sheet goods.

Yet another aspect of the present invention is a storage and dispensing apparatus comprising a lower cartridge containing section comprising a front access door member providing access to the containing section.

Yet another aspect of the present invention is a storage and dispensing apparatus comprising an upper cartridge containing section comprising a top access door member providing access to the containing section.

Yet another aspect assembles access door member to the housing via a hingeable coupling interface.

Yet another aspect assembles access door member to the housing via a slideable coupling interface.

These and other features, aspects, and advantages of the invention will be further understood and appreciated by those skilled in the art by reference to the following written specification, claims, and appended drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the various views of the drawings.

DETAILED DESCRIPTION OF THE PREFERRED EMBODIMENT

Figure 1:
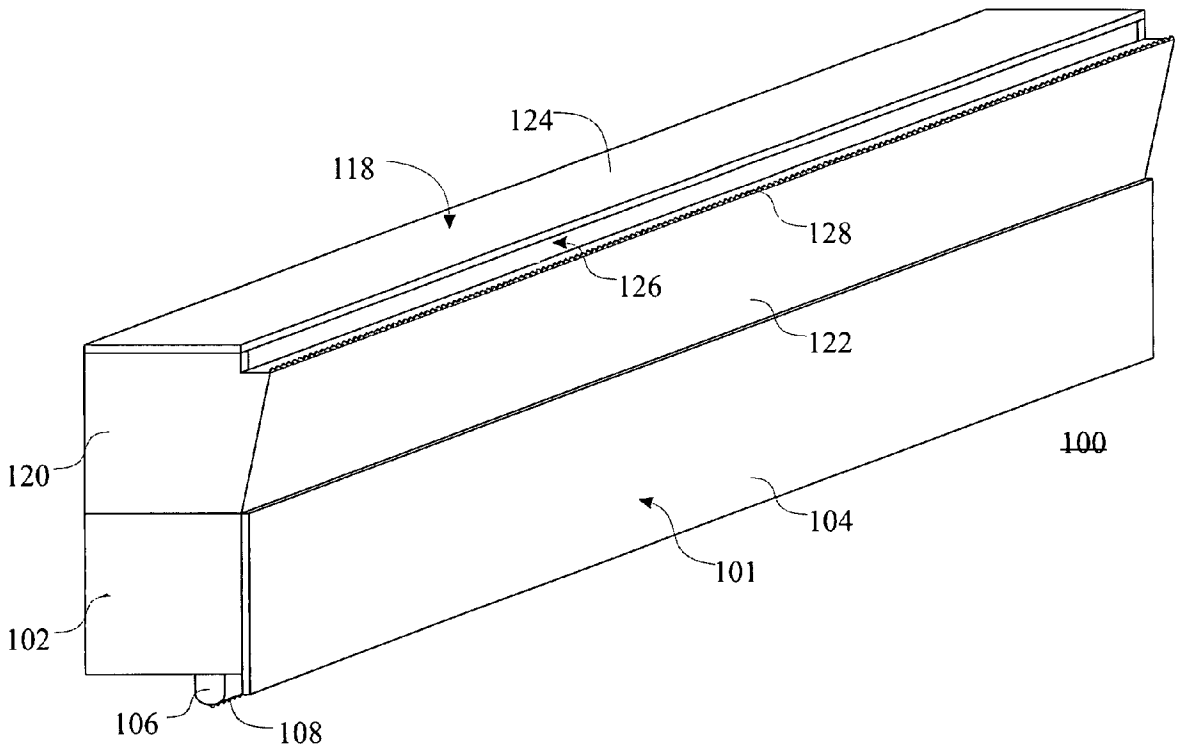
FIG. 1 is an isometric view of a dual compartment rolled food storage sheet goods dispenser.

For purposes of description herein, the terms "upper", "lower", "left", "rear", "right", "front", "vertical", "horizontal", and derivatives thereof shall relate to the invention as oriented in FIG. 1. However, one will understand that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
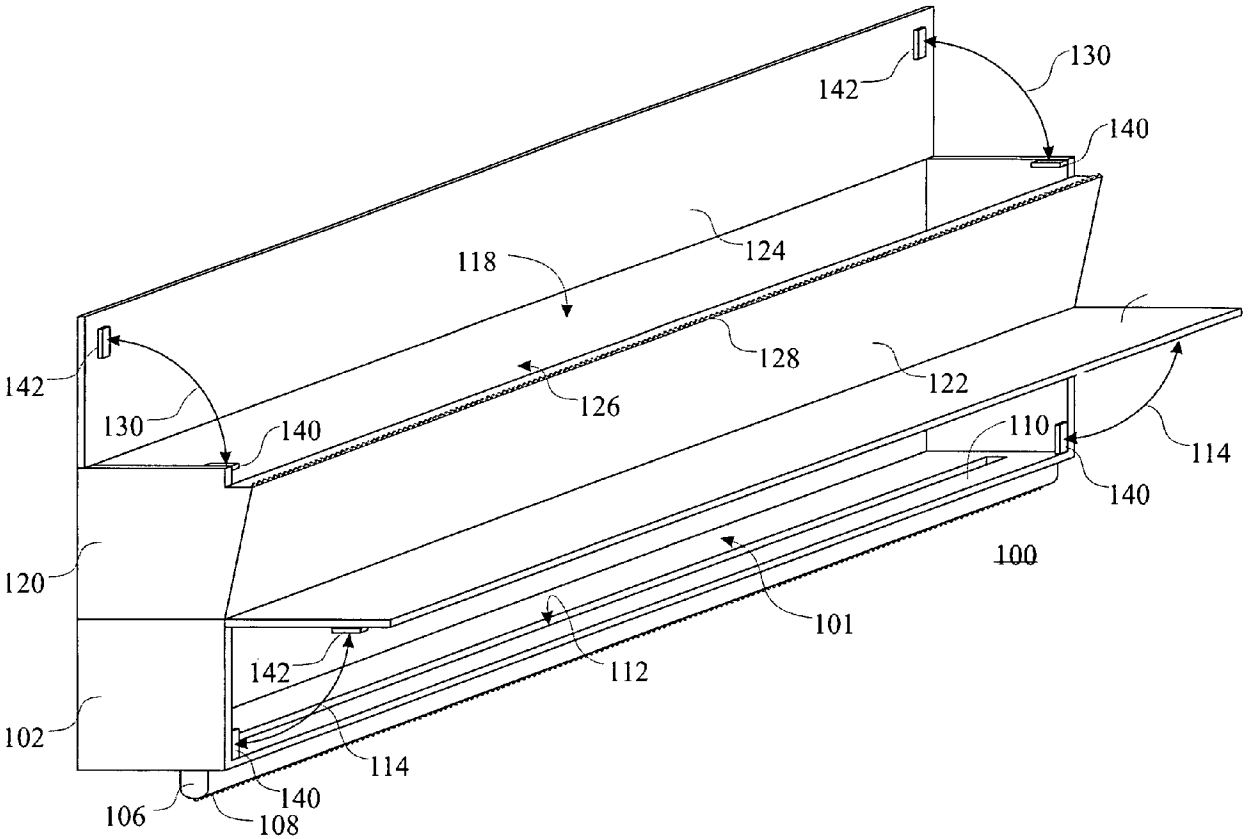
FIG. 2 is an isometric view of the dual compartment rolled food storage sheet goods dispenser as presented in FIG. 1, presenting the compartments in an open configuration.

Turning to the drawings, FIGS. 1 and 2 present the structure and components of a dual food storage sheet goods dispenser 100. The dual food storage sheet goods dispenser 100 is divided into two (2) subsections, a lower cartridge compartment section 101, and an upper cartridge compartment section 118. The lower cartridge compartment section 101 is fabricated in a shape of an elongated rectangular box, having a lower cartridge compartment end wall 102 on each of the two ends, a lower cartridge compartment access door 104 assembled to a front of the lower cartridge compartment section 101 and a lower cartridge compartment bottom 110 assembled to a bottom of the lower cartridge compartment section 101. The lower cartridge compartment section 101 further comprises a top and a rear wall section (not shown but understood by description). The lower cartridge compartment access door 104 can be hingably assembled to the lower cartridge compartment section 101, providing access to an interior compartment of the lower cartridge compartment section 101 via a lower door motion 114. A lower cartridge dispensing slot 112 is fabricated in the lower cartridge compartment bottom 110, wherein the lower cartridge dispensing slot 112 provides a port for dispensing of the rolled sheet goods. A lower shearing edge 108 is disposed onto a lower cutting edge carrier 106, and the assembly is affixed to a bottom of the lower cartridge compartment bottom 110, located between the lower cartridge dispensing slot 112 and a front edge of the lower cartridge compartment section 101. The lower cutting edge carrier 106 and lower shearing edge 108 provide a guide and geometry conducive for the shearing of the rolled sheet goods. Housing magnets 140 are affixed to either the lower cartridge compartment end wall 102 or the lower cartridge compartment bottom 110 of the lower cartridge compartment section 101. Door magnets 142 are affixed to the lower cartridge compartment access door 104, each at a location that aligns with the housing magnets 140, when the lower cartridge compartment access door 104 is placed in a closed orientation. The lower cartridge compartment access door 104 is secured in a closed configuration via magnetic attraction between housing magnets 140 and each respective door magnet 142.

The upper cartridge compartment section 118 is fabricated in a shape of an elongated rectangular box, having a upper cartridge compartment end wall 120 on each of the two sides, a upper cartridge compartment access door 124 assembled to a top of the upper cartridge compartment section 118 and a upper cartridge compartment front wall 122 assembled to a front of the upper cartridge compartment section 118. The upper cartridge compartment section 118 further comprises a bottom and a rear wall section (not shown but understood by description). The upper cartridge compartment access door 124 can be hingably assembled to the upper cartridge compartment section 118, providing access to an interior compartment of the upper cartridge compartment section 118 via a upper door motion 130. An upper cartridge dispensing gap 126 is formed between the upper cartridge compartment access door 124 and the upper cartridge compartment front wall 122, wherein the upper cartridge dispensing gap 126 provides a port for dispensing of the rolled sheet goods. An upper serrated edge 128 is affixed onto a top edge of the upper cartridge compartment front wall 122. The upper cartridge compartment front wall 122 is angled, providing a guide and geometry conducive for the shearing of the rolled sheet goods via the upper serrated edge 128. Housing magnets 140 are affixed to either the upper cartridge compartment end wall 120 or the upper cartridge compartment front wall 122 of the upper cartridge compartment section 118. Door magnets 142 are affixed to the upper cartridge compartment access door 124 at a location that aligns with the fixed magnets 140, when the upper cartridge compartment access door 124 is placed in a closed orientation. The upper cartridge compartment access door 124 is secured in a closed configuration via magnetic attraction between the housing magnets 140 and each respective door magnet 142.

Figure 3:
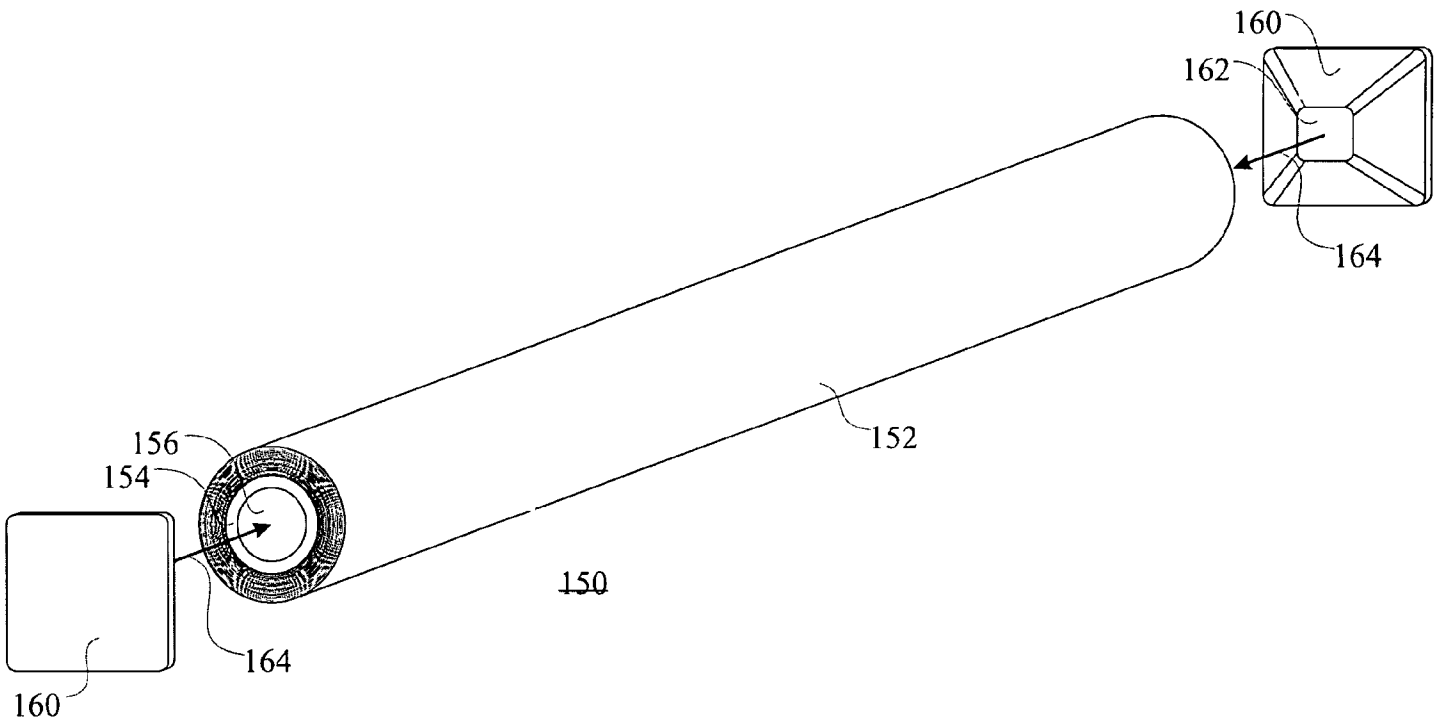
FIG. 3 is an isometric view of a rolled food storage sheet goods and an exemplary roll supports embodiment.
Figure 4:
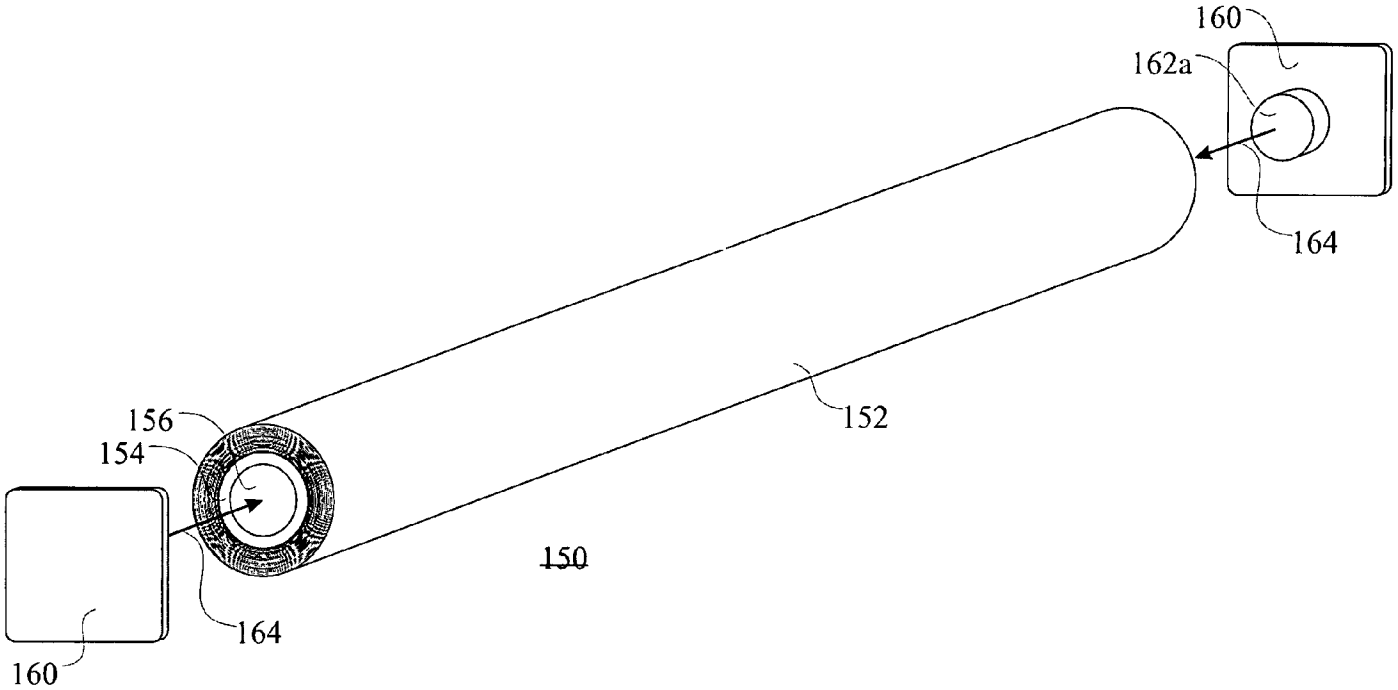
FIG. 4 is an isometric view of a rolled food storage sheet goods and an alternate roll supports embodiment.
Figure 5:
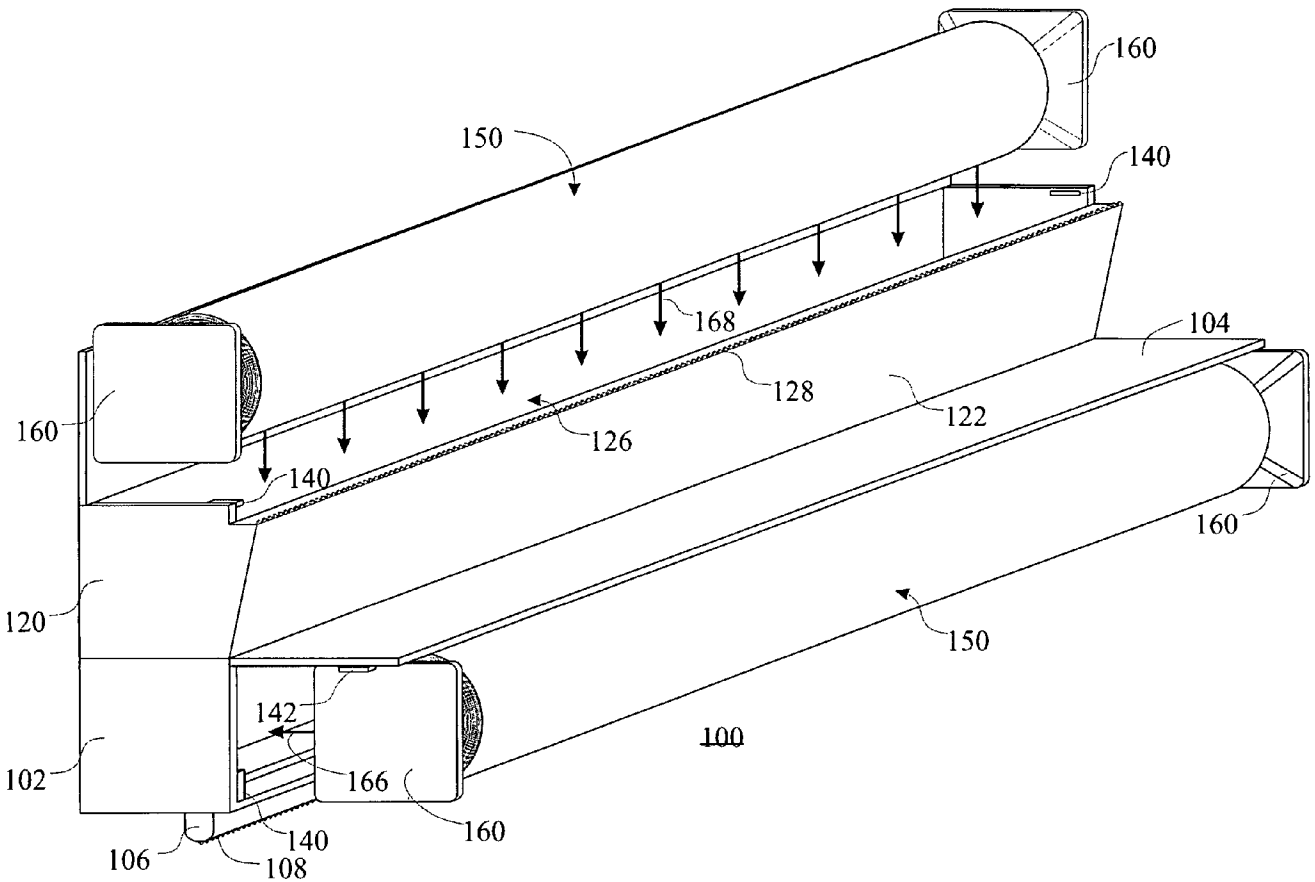
FIG. 5 is an isometric view of the dual compartment rolled food storage sheet goods dispenser as presented in FIG. 1, further presenting the insertion of the food storage sheet goods rolls into each of the two compartments.
Figure 6:
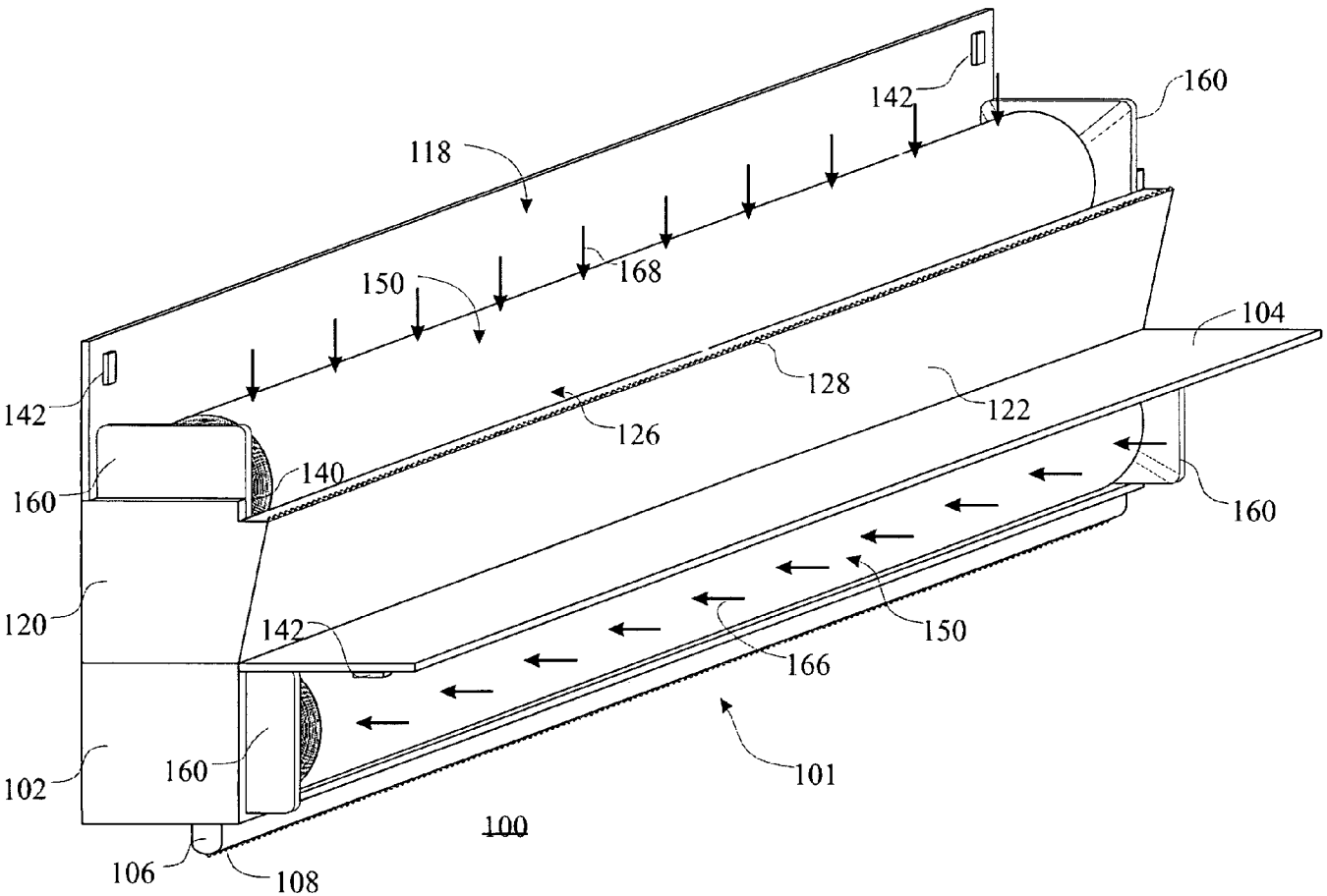
FIG. 6 is an isometric view of the dual compartment rolled food storage sheet goods dispenser as presented in FIG. 1, further presenting the food storage sheet goods rolls partially inserted into each of the two compartments.
Figure 7:
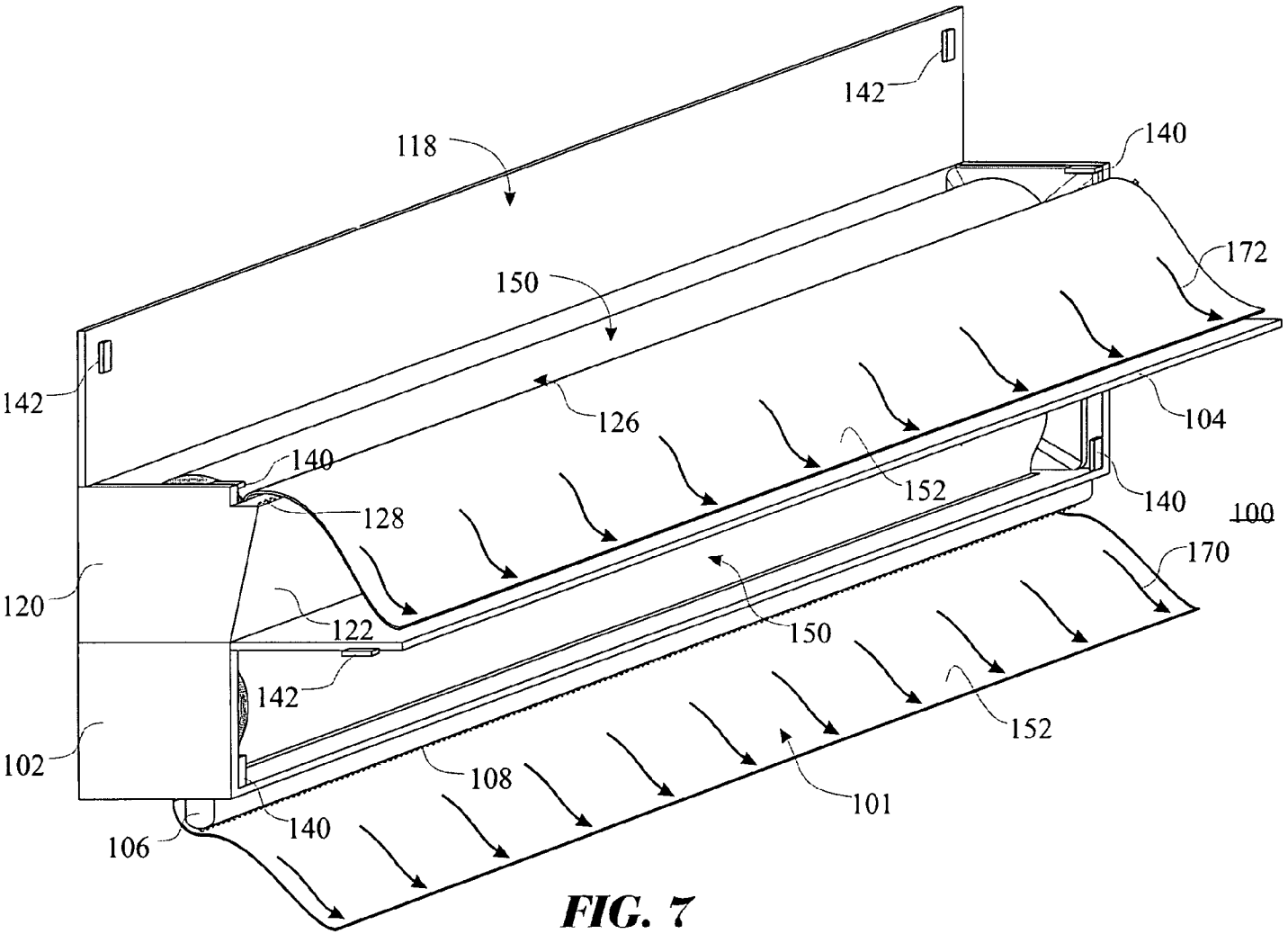
FIG. 7 is an isometric view of the dual compartment rolled food storage sheet goods dispenser as presented in FIG. 1, further presenting the food storage sheet goods rolls seated into each of the two compartments.
Figure 8:
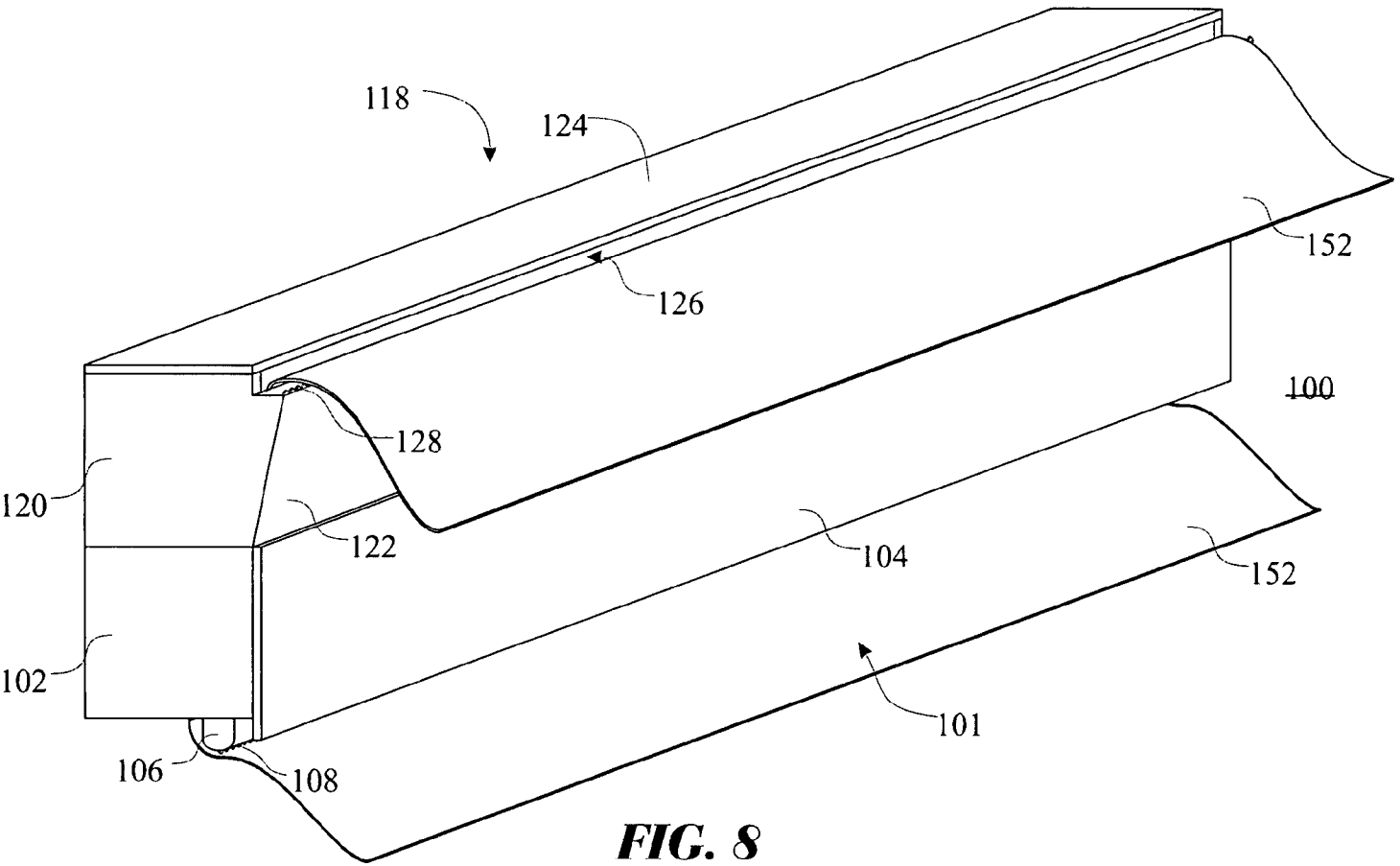
FIG. 8 is an isometric view of the dual compartment rolled food storage sheet goods dispenser as presented in FIG. 1, further presenting the food storage sheet goods rolls seated as being dispensed.
Figure 10:
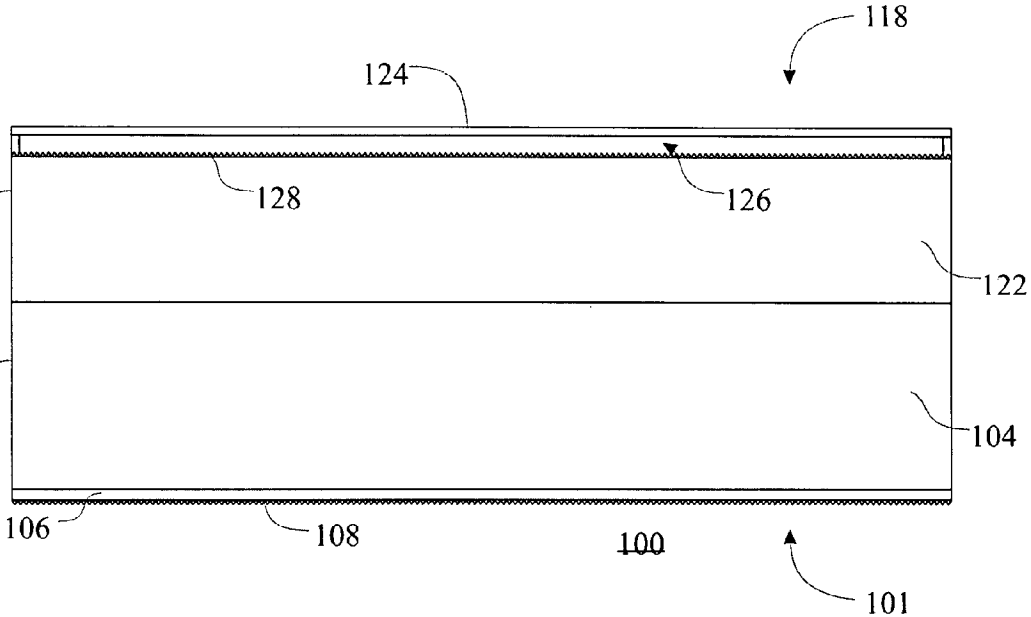
FIG. 10 is a front view of the dual compartment rolled food storage sheet goods dispenser as presented in FIG. 1.
Figure 9:
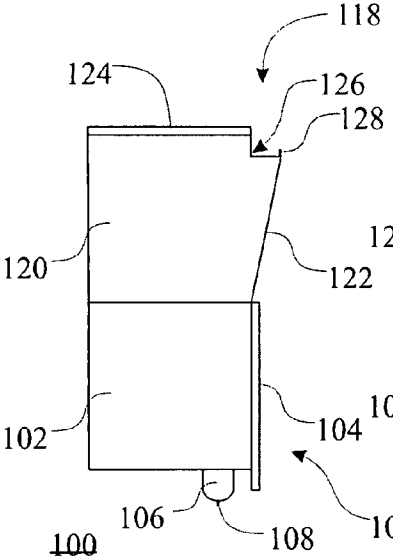
FIG. 9 is a left side view of the dual compartment rolled food storage sheet goods dispenser as presented in FIG. 1.
Figure 11:
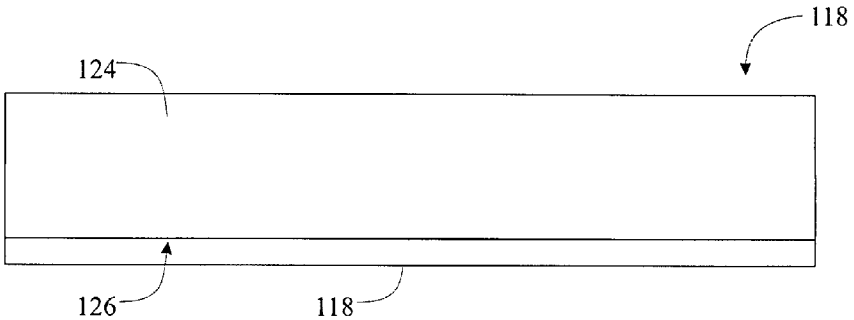
FIG. 11 is a top view of the dual compartment rolled food storage sheet goods dispenser as presented in FIG. 1.
Figure 12:
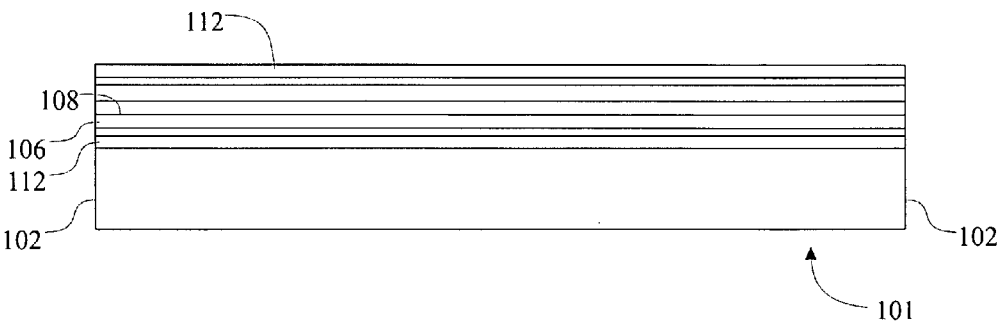
FIG. 12 is a bottom view of the dual compartment rolled food storage sheet goods dispenser as presented in FIG. 1.

A sheets good food wrap cartridge assembly 150 is assembled by inserting a pair of cartridge end caps 160 into a sheet goods core center 156 on each end of a sheet goods tubular core 154 as illustrated in FIGS. 3 and 4. The food wrap sheet goods 152 are wrapped about the sheet goods tubular core 154. The cartridge end caps 160 are formed having a core mounting protrusion 162 for inserting into each of the respective 156 via an end cap assembly step 164. The core mounting protrusion 162 (FIG. 3) is formed having a tapering, generally square geometry. The tapered core mounting protrusion 162 provides a friction force between the sheet goods tubular core 154 and the core mounting protrusion 162. The core mounting protrusion 162*a* (FIG. 4) is formed having a generally circular geometry. The linear core mounting protrusion 162*a* provides a lift with limited friction, supporting the food wrap sheet goods 152 in a manner to de-spool from the sheet goods tubular core 154 without rubbing the food wrap sheet goods 152 against a bottom of the compartment. It is understood that other geometries can be utilized for the core mounting protrusion 162, such as an oval, a star, a rectangle, a cross, and the like.

The insertion and dispensing of the food wrap sheet goods 152 is presented in FIGS. 5 through 8. The user would open the lower cartridge compartment access door 104 and the upper cartridge compartment access door 124 to gain access to each of the two compartments 101, 118. The sheets good food wrap cartridge assembly 150 is inserted into the lower cartridge compartment section 101 via a lower cartridge insertion 166 and the sheets good food wrap cartridge assembly 150 is inserted into the upper cartridge compartment section 118 via a upper cartridge insertion 168. In a preferred embodiment, the roll 150 inserted into the lower cartridge compartment section 101 is of a plastic wrap and the roll 150 inserted into the lower cartridge compartment section 101 is of an aluminum foil. The lower sheets good food wrap cartridge assembly 150 is routed through the lower cartridge dispensing slot 112 then down-ward and passing across the lower shearing edge 108. The lower shearing edge 108 is preferably serrated, whereby the food wrap sheet goods 152 grabs onto the teeth of the serrated lower shearing edge 108. The dispensing path is presented as a lower cartridge dispensing path 170. The upper sheets good food wrap cartridge assembly 150 is routed through the upper cartridge dispensing gap 126 passing across the upper serrated edge 128. The dispensing path is presented as an upper cartridge dispensing path 172. The upper serrated edge 128 is disposed upon the top edge of the upper cartridge compartment front wall 122. The upper cartridge compartment front wall 122 is angled projecting outward towards the top edge. This configuration provides assistance to the shearing process. The upper serrated edge 128 is preferably serrated, whereby the food wrap sheet goods 152 grabs onto the teeth of the serrated upper serrated edge 128. Once the sheets good food wrap cartridge assembly 150 is inserted into each of the two compartments 101, 118 and the food wrap sheet goods 152 is properly routed for use, the user closed each of the access doors 104, 124.

Additional illustrations of the dual food storage sheet goods dispenser 100 are presented in FIGS. 9 through 12, presenting the left side (symmetric to the right side), the front, the top, and the bottom, respectively. The lower cutting edge carrier 106 projects down-ward from the bottom of lower cartridge compartment section 101 to aid in the shearing process of the food wrap sheet goods 152. The user would pull the desired amount of the food wrap sheet goods 152 downward, then turning forward and slightly upward to shear the material. The lower cartridge compartment access door 104 can extend slightly below the bottom of the lower cartridge compartment section 101, but not equal to the bottom of the lower cutting edge carrier 106, providing a lip for assisting the user in the lower door motion 114. The upper cartridge compartment front wall 122 is angled, wherein a top edge is positioned forward of the bottom edge. The user would pull the desired amount of the food wrap sheet goods 152 outward, then turning the material downward for shearing. With the upper cartridge compartment front wall 122 being angled, the apparatus provides clearance, wherein the user simply applies a downward force shearing the food wrap sheet goods 152 via the upper serrated edge 128.

Figure 13:
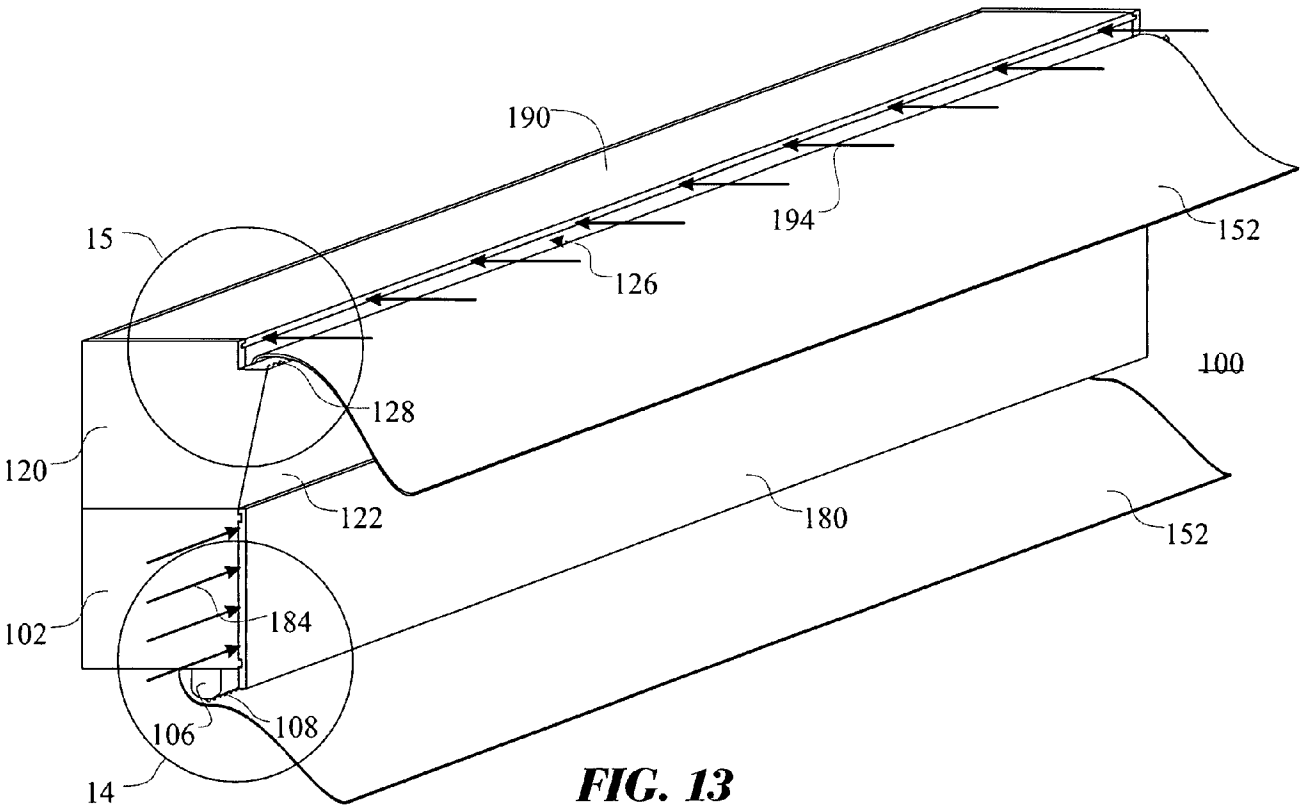
FIG. 13 is an isometric view of a dual compartment rolled food storage sheet goods dispenser comprising an alternate access door embodiment.
Figure 15:
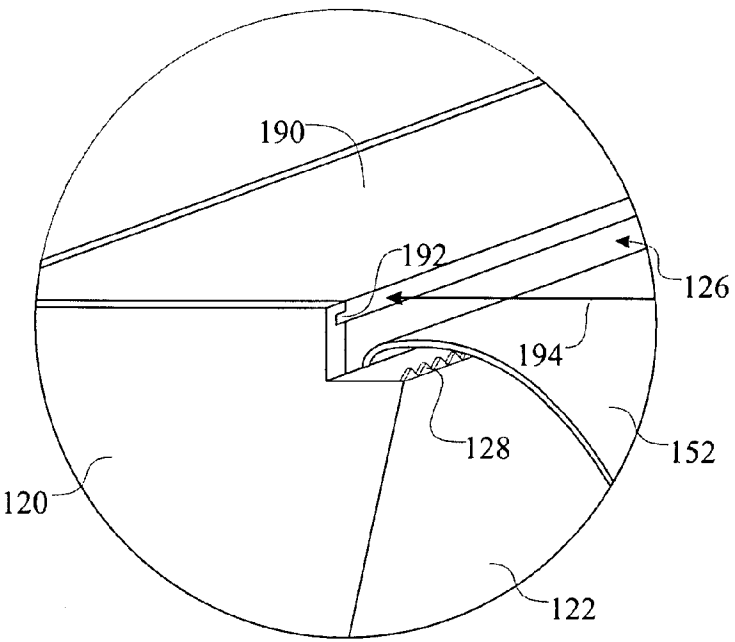
FIG. 15 is a detailed view of an alternate slide interface design for the access door.
Figure 14:
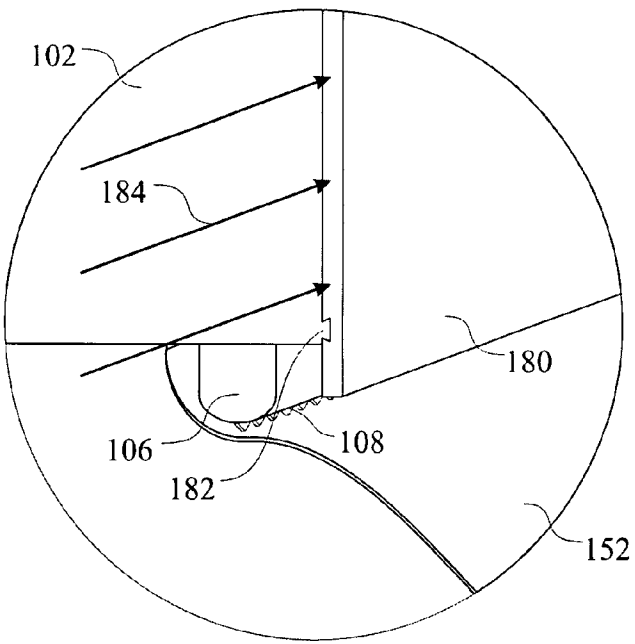
FIG. 14 is a detailed view of one slide interface design for the access door.

An alternate access door having a sliding interface is presented in FIG. 13 with details of two slide designs being illustrated in FIGS. 14 and 15. In the alternate embodiment, the hingably connected doors 104, 124 are replaced with slideably connected doors 180, 190. The orientations of each slideably connected door 180, 190 dictates certain requirements. The sliding front access door 180 is oriented vertically, wherein the sliding design needs to consider gravity. One solution is a horizontally oriented sliding dovetail joint 182. The sliding dovetail joint 182 would be provided along top and bottom edges of the lower cartridge compartment end wall 102. The user would slide the sliding front access door 180 front either left to right via a side to side sliding door insertion 184 (or right to left) assembling the sliding front access door 180 to the lower cartridge compartment end wall 102 via the horizontally oriented sliding dovetail joint 182. The sliding dovetail joint 182 provides a smooth, aesthetically pleasing interface between the sliding top access door 190 and the lower cartridge compartment end wall 102. The sliding top access door 190 is oriented horizontally, wherein the effects of gravity are not as critical. The sliding top access door 190 is slideably coupled to both a left and a right upper cartridge compartment end wall 120 via a sliding half lap joint 192. The sliding top access door 190 is inserted via a front to rear sliding door insertion 194. The sliding half lap joint 192 interface can be designed such to provide a flush top surface.

The dual food storage sheet goods dispenser 100 is fabricated of any known material, including but not limited to wood, plastic, composite, metal, and any combination therein. Each of the walls: lower cartridge compartment end wall 102, lower cartridge compartment access door 104, lower cartridge compartment bottom 110, upper cartridge compartment end wall 120, upper cartridge compartment front wall 122, and upper cartridge compartment access door 124, as well as a back and a center member are fabricated individually and jointed using a method respective to the material. Each of the right and left end walls 102, 120, can optionally be fabricated as a single member.

Yet another method for manufacturing can be accomplished via an extrusion process. The back (rear) member (not shown but understood), bottom 110, upper to lower cartridge horizontal divider (located between the upper and lower cartridge compartments), and the upper cartridge front wall 122 can be extruded as one member. The extrusion is then cut to length, whereby the two end walls are assembled. The extrusion can include fastener receiving features, which are well known in the extrusion industry. The slot 112 is then cut into the bottom 110 via a tool and die process, machined using any machining process, or formed via any other known process. The access doors 104, 124 are fabricated and assembled to the housing extrusion. The magnetic closure components 140, 142 are fastened to the assembly via an adhesive. The cutting edges 108, 128 are assembled in accordance with the embodiments presented herein.

What is claimed is:

1. A dual compartment food wrap storage dispenser, the dual compartment dispenser comprising:

a lower cartridge compartment, the lower compartment comprising a bottom member, a rear member, a left end wall, a right end wall, and a lower compartment front member, wherein said lower compartment front member is a lower compartment access door;

an upper cartridge compartment, the upper compartment comprising a rear member, a left end wall, a right end wall, an upper compartment front member, and a top member, wherein said top member is an upper compartment access door;

a dividing member disposed horizontally between the lower cartridge compartment and the upper cartridge compartment;

a lower dispensing slot laterally spanning the bottom member of the lower cartridge compartment;

a lower shearing edge located laterally and between the lower dispensing slot and the lower compartment access door; and an upper shearing edge located laterally proximate a top edge of the upper compartment front member.

2. A dual compartment food wrap storage dispenser as recited in claim 1, the dual compartment food wrap storage dispenser further comprising a pair of cartridge end caps for each compartment, wherein each end cap comprises a core mounting protrusion, wherein an end of the core mounting protrusion having a diameter sized such to be inserted into a standard sheet goods tubular core center.

3. A dual compartment food wrap storage dispenser as recited in claim 2, the wherein the core mounting protrusion of the cartridge end caps is tapered.

4. A dual compartment food wrap storage dispenser as recited in claim 1, wherein at least one of the lower shearing edge and the upper shearing edge is serrated.

5. A dual compartment food wrap storage dispenser as recited in claim 1, wherein the upper compartment front member is angled projecting outward towards a top of the upper compartment front member.

6. A dual compartment food wrap storage dispenser as recited in claim 1, the dual compartment food wrap storage dispenser further comprising:

a lower compartment cutting edge carrier;

wherein the lower compartment cutting edge carrier is disposed upon an exterior of the lower compartment bottom member; and wherein the cutting edge is disposed upon the a lower region of the lower compartment cutting edge carrier therein.

7. A dual compartment food wrap storage dispenser as recited in claim 1, wherein at least one of:

a. the lower compartment access door is hingeably coupled to the dual compartment food wrap storage dispenser; and b. the upper compartment access door is hingeably coupled to the dual compartment food wrap storage dispenser.

8. A dual compartment food wrap storage dispenser as recited in claim 1, wherein at least one of:

a. the lower compartment access door is slideably coupled to the dual compartment food wrap storage dispenser; and b. the upper compartment access door is slideably coupled to the dual compartment food wrap storage dispenser.

9. A dual compartment food wrap storage dispenser, the dual compartment dispenser comprising:

a lower cartridge compartment, the lower compartment comprising a bottom member, a rear member, a left end wall, a right end wall, and a lower compartment front member, wherein said lower compartment front member is a lower compartment access door;

an upper cartridge compartment, the upper compartment comprising a rear member, a left end wall, a right end wall, an upper compartment front member, and a top member, wherein said top member is an upper compartment access door;

an upper compartment dispensing gap, the gap being formed between the upper compartment front member and the top member;

a dividing member disposed horizontally between the lower cartridge compartment and the upper cartridge compartment;

a lower dispensing slot laterally spanning the bottom member of the lower cartridge compartment;

a lower shearing edge located laterally and between the lower dispensing slot and the lower compartment access door; and an upper shearing edge located laterally proximate a top edge of the upper compartment front member.

10. A dual compartment food wrap storage dispenser as recited in claim 9, the dual compartment food wrap storage dispenser further comprising a pair of cartridge end caps for each compartment, wherein each end cap comprises a core mounting protrusion, wherein an end of the core mounting protrusion having a diameter sized such to be inserted into a standard sheet goods tubular core center.

11. A dual compartment food wrap storage dispenser as recited in claim 10, the wherein the core mounting protrusion of the cartridge end caps is tapered.

12. A dual compartment food wrap storage dispenser as recited in claim 9, wherein at least one of the lower shearing edge and the upper shearing edge is serrated.

13. A dual compartment food wrap storage dispenser as recited in claim 9, wherein the upper compartment front member is angled projecting outward towards a top of the upper compartment front member.

14. A dual compartment food wrap storage dispenser as recited in claim 9, the dual compartment food wrap storage dispenser further comprising:

a lower compartment cutting edge carrier;

wherein the lower compartment cutting edge carrier is disposed upon an exterior of the lower compartment bottom member; and wherein the cutting edge is disposed upon the a lower region of the lower compartment cutting edge carrier therein.

15. A dual compartment food wrap storage dispenser as recited in claim 9, wherein at least one of:

a. the lower compartment access door is hingeably coupled to the dual compartment food wrap storage dispenser; and b. the upper compartment access door is hingeably coupled to the dual compartment food wrap storage dispenser.

16. A dual compartment food wrap storage dispenser as recited in claim 9, wherein at least one of:

a. the lower compartment access door is slideably coupled to the dual compartment food wrap storage dispenser; and b. the upper compartment access door is slideably coupled to the dual compartment food wrap storage dispenser.

17. A dual compartment food wrap storage dispenser, the dual compartment dispenser comprising:

a lower cartridge compartment, the lower compartment comprising a bottom member, a rear member, a left end wall, a right end wall, and a lower compartment front member, wherein said lower compartment front member is a lower compartment access door;

an upper cartridge compartment, the upper compartment comprising a rear member, a left end wall, a right end wall, an upper compartment front member, and a top member, wherein said top member is an upper compartment access door;

an upper compartment dispensing gap, the gap being formed between the upper compartment front member and the top member;

a dividing member disposed horizontally between the lower cartridge compartment and the upper cartridge compartment;

a lower dispensing slot laterally spanning the bottom member of the lower cartridge compartment;

a lower shearing edge located laterally and disposed upon a lower cutting edge carrier, the lower cutting edge carrier projecting downward from an exterior of the bottom member of the lower cartridge compartment, and wherein the lower cutting edge carrier is located between the lower dispensing slot and the lower compartment access door; and an upper shearing edge located laterally proximate a top edge of the upper compartment front member.

18. A dual compartment food wrap storage dispenser as recited in claim 17, wherein the upper compartment front member is angled projecting outward towards a top of the upper compartment front member.

19. A dual compartment food wrap storage dispenser as recited in claim 17, the dual compartment food wrap storage dispenser further comprising a pair of cartridge end caps for each compartment, wherein each end cap comprises a core mounting protrusion, wherein an end of the core mounting protrusion having a diameter sized such to be inserted into a standard sheet goods tubular core center.

20. A dual compartment food wrap storage dispenser as recited in claim 19, the wherein the core mounting protrusion of the cartridge end caps is tapered.

* * * * *